US005955375A

United States Patent [19]

Zondlo et al.

[11] Patent Number: 5,955,375

[45] Date of Patent: Sep. 21, 1999

[54] PRODUCTION OF COAL DERIVATION PRODUCTS UTILIZING NMP-TYPE SOLVENT EXTRACTION

[76] Inventors: John W. Zondlo, 252 Waitman St.; Peter G. Stansberry, 345 Jackson Ave.; Alfred H. Stiller, 443 Jefferson St., all of Morgantown, W. Va. 26505

[21] Appl. No.: 08/429,143

[22] Filed: Apr. 26, 1995

[51] Int. Cl.[6] ..... C01B 31/00; C10B 57/00

[52] U.S. Cl. ..... 436/145; 423/445 R; 423/448; 208/427

[58] Field of Search ..... 423/445 R, 448; 208/435, 427; 502/418; 436/145

[56] References Cited

U.S. PATENT DOCUMENTS

| | | | |
|---|---|---|---|
| 4,029,749 | 6/1977 | Murakami | 423/448 |
| 4,259,083 | 3/1981 | Ignasiak | 44/1 F |

OTHER PUBLICATIONS

J.H. Perry *Chemical Engineer's Handbook*, 3rd ed. 1950 pp. 1560–1566.

*Primary Examiner*—Wayne Langel
*Assistant Examiner*—Stuart L. Hendrickson
*Attorney, Agent, or Firm*—William J. Daniel

[57] ABSTRACT

A graphite of anisotrophy selected between substantially isotropic to highly anisotropic, or calcined coke graphitizable to such a graphite, or a pitch convertible into such a coke or graphite, is derived from bituminous coal. A first coal is extracted in NMP or like solvent to give a first extract that when carbonized alone produces a substantially isotropic coke. A second coal (the same or different as the first coal) is hydrogenated and similarly extracted to give a second extract. The extent of hydrogenation is controlled so that the second extract when carbonized alone produces a highly anisotropic coke. Test samples are prepared by combining the two extracts in differing ratios including one sample in a ratio at each range end of the range. The solids of each sample are recovered, carbonized into coke, and then optionally converted into graphite, and its degree of anisotrophy analyzed. Comparison of the analyzed degrees for the different coke or graphite samples gives an correlation (e. g. a curve), that is characteristic for the coal treated. From this correlation, the two fractions can be solution blended in correct proportion to give a pitch yielding a coke or graphite of a selected anisotrophy or the coke or graphite can be produced therefrom. Alternatives are disclosed for combining the coals as such for extraction or variably hydrogenating a single coal to correspond in either case to a selected degree of anisotrophy.

18 Claims, 2 Drawing Sheets

PRODUCTION OF COAL DERIVATION PRODUCTS UTILIZING NMP-TYPE SOLVENT EXTRACTION

FIELD OF THE INVENTION

This invention relates to the field of graphite production and is concerned more particularly with the production of graphite of substantially controlled or selective anisotropicity.

BACKGROUND OF THE INVENTION

Graphite is a highly valuable industrial commodity, by virtue of a unique combination of physical and chemical properties. Graphite has a remarkable resistance to high temperatures (when maintained in a non-oxidizing atmosphere), and resistance to thermal shock, together with a high resistance to flow therethrough of electrical current, Consequently, it is ideally suited for the formation of industrial electrodes, especially for steel making furnaces and the like, which can be of very large size, e. g. up to 12' or more in length and 2 to 3' or greater in diameter, as well as for crucibles, molds, and the like for receiving and/or shaping molten metals. It is essentially inert to chemical or corrosive attack and is thus peculiarly well adapted as a structural material for chemical reactors, as an electrode in the electrolytic production of various chemicals, such as chlorine, caustic soda and so on, and metals, such as magnesium and titanium. It is also an effective absorber of nuclear radiation and hence finds extensive application as a construction and shielding material for nuclear reactors.

As is apparent, many of these applications entail exposure of the graphite to more or less high temperature and therefore, the thermal expansion properties of graphite becomes a significant, or even critical, property, depending, of course, on the specific application. In most situations, the graphite will be in the form of bodies of considerable size and thermal expansion will take place in two perpendicular directions, i. e. axially and transversely, so that the relative extent of the thermal expansion in these two directions, i. e. the ratio of axial to transverse expansion or vice versa, becomes a determining factor in the suitability of a particular graphite for a particular end use.

As with various other materials, the thermal expansion of graphite is measured in terms of a "coefficient of thermal expansion" (CTE), i. e. the change in length per unit length per degree of temperature variation, often reported as $10^{-7}$ in/in/ °F., and from such values, the ratio can be determined. Crystalline graphite is constituted of carbon atoms bonded trigonally and arranged in planar sheets which are stacked perpendicular to the planes of the sheets. For a true crystalline graphite, the CTE in a direction parallel to these planes (which is considered to be the "axial" direction) is quite low, perhaps as low as 0.1 whereas the CTE in a direction normal to the planes (which is considered the "transverse" direction), is quite perhaps as high as or higher than 20. Such as material is obviously highly "anisotropic". Fur some purposes, for example, for making electrodes for steel production, where the graphite body is essentially elongated, high anisotropicity can be tolerated or even desirable.

On the other hand, where the primary function of the graphite in a given end use is structural, e. g. in a nuclear reactors, it is usually desirable for the graphite to exhibit generally the same CTE in both directions so that any expansion with temperature is about the same in both directions, minimizing the risk of cracking or other loss of structural integrity due to uneven expansion. Such a graphite is referred to as "isotropic". In still other cases of end uses, for example in electrodes for electrolytic refining of aluminum, an intermediate degree of anisotropicity is preferable.

For an extensive discussion of the production of graphite particularly for electrode use with full details of the techniques and procedures employed for the various steps involved, reference may be had to the article "GRAPHITE ELECTRODES—A Staff-Industry Collaborative Report", Industrial and Engineering Chemistry, Vol 46, No. 1, January, 1954, pp. 2–11, which is incorporated by reference herein.

Although strictly speaking, it is the ratio of CTE values that determines isotropicity or anisotropicity, as a general rule in the graphite industry, a relatively high CTE value in the axial direction, e. g. about 4 or higher, is taken as a matter of convenience as an indication of a substantially isotropic material. Conversely, an axial CTE value of about 1 or below is taken as an indication of a relatively highly anisotropic graphite. While different graphites can exhibit variation in the degree of transverse thermal expansion, that variation is presumably significantly less than the variation in axial expansion so that this approximation is a useful guideline.

Natural graphite is available in ample quantities but is rarely because it contains significant amounts of impurities and its purification is expensive. Instead, virtually all "modern" graphite is so-called synthetic or artificial graphite. Although coal, especially anthracite coal, in the beginning served as the primary raw material for making graphite, for at least the last 75 years or so, the primary raw material for synthetic graphite in the United States has been petroleum coke, i. e. a coke residue from the refining by destructive distillation or cracking of petroleum into lighter fractions, such as gasoline, etc. Being essentially a by-product in a process aimed at other higher value products, the quality of the resultant coke has not been a major concern to the petroleum refining industry and the properties of petroleum coke may differ from refiner to refiner or from refining run to run. Moreover, the coke from different kinds of crude oil can vary and as natural sources of high quality ("sweet") crude oil become exhausted, compelling the refining industry turn to lower quality crude oils, the consistent availability of petroleum coke having properties desirable for graphite production is an increasing problem to the synthetic graphite industry.

In our patent application Ser. No. 08/302,481, filed Sep. 12, 1994, which is a continuation of application Ser. No. 07/949,985), filed Sep. 24, 1992, we described and claimed our unexpected discovery that a high quality strongly isotropic graphite could be produced from a coal fraction derived by solvent extraction of a bituminous coal utilizing as the extraction solvent N-methyl pyrrolidone (NMP) or an equivalent thereof by the low temperature carbonization (i. e. at around 500° C.) and/or medium temperature carbonization (i. e. at around 1000° C.) followed by graphitization at around 2800–3000° C. or higher, all under non-oxidizing conditions. The details of the extraction procedure employing such a solvent as well as the class of solvents effective therein are set forth in U.S. Pat. No. 4,272,356 to Stiller et al to which reference may be had to additional information.

Analysis of a number of petroleum cokes suitable for graphitization which are available in the United States established that they are highly variable depending on coke type and source, with, for instance an axial CTE ranging from 0.15 to over 4.0. It is possible to produce cokes for graphitization from pitches derived from coal tars but at the present time, all available are from foreign sources, mainly Japan, Typically, these cokes have an axial CTE in the range of about 3–4 and are thus relatively isotropic in nature. Parenthetically, the isotropic/anisotropic character of a graphitizable coke essentially carries over into the ultimate graphite and thus the thermal expansion behavior as a measure of the isotropicity or anisotropicity of a given coke can be considered to be a reliable indication of the thermal expansion behavior of a graphite made from than coke. That is to say, if a calcined coke exhibits substantial isotropicity, the graphite produced from that calcined coke will exhibit substantially the same isotropicity; similarly, if a calcined coke is substantially or highly anisotropic, the graphite produced from that coke will have essentially the same degree of anisotropicity; and the same correspondence applies between these extremes.

As noted above, there is a definite commercial need for graphites having some intermediate level of anisotropicity between substantially isotropic and highly anisotropic. Up to now, the synthetic graphite industry has dealt with this need by forming mixtures in ground or powdered form of a plurality of different cokes having different thermal expansion behavior in order to achieve a suitable graphite. Necessarily, this involves a good deal of experimental trial and error before the proper or desired combination of properties in the final graphite has been reached. Furthermore, even when the coke mixture is finely ground, there is in the final graphite a perceptible non-homogeneity on a microscopic scale which is undesirable but thus far unavoidable.

If it were possible in some economically feasible manner to produce graphites of generally or substantially controlled or selective anisotropicity between the extreme limits of almost 0% anisotropicity (i. e. highly) isotropic) and highly substantially anisotropic and that are free of this microscopic non-homogeneity, this would be a valuable step forward in the graphite field.

SUMMARY OF THE INVENTION

In accordance with the invention, two techniques have been discovered whereby it is possible to produce graphites of generally or substantially selective anisotropicity with essentially perfect homogeneity. In one case, anisotropicity of the ultimate graphite is possible by subjecting a starting bituminous coal to selective or controlled hydrogenation ranging from zero hydrogenation to substantial hydrogenation to yield by appropriate processing involving solvent extraction of the starting coal in an NMP-type extraction solvent as defined in the above-identified Stiller et al patent followed by the thermal treatments necessary to convert the extraction product into graphite, including carbonization, calcination, and graphitization, the extent of anisotropicity between substantially isotropic and substantially anisotropic being a function generally of the degree of hydrogenation. In the other case, when a non-hydrogenated coal together with a substantially hydrogenated coal are extracted with a NMP-type extraction solvent and are solution blended together in proportions ranging in the broadest sense from 100/0 to 0/100 pts by wt, and proportions therebetween, and each solution blend is subjected to the heat treatment conditions needed to produce graphite, the graphite exhibits an extent of anisotropicity which is a function generally of the proportions of the extracted matter derived from the respective coals present in the solution blend.

In either case, the precise functional relation is a property of the starting coal or coals and because of the random natural composition of bituminous coals in general can vary from coal to coal or even between different batches of a given coal. However, by a preliminary small scale testing, that functional characteristic of a given coal from an non-hydrogenated to a substantially hydrogenated state or of a given solution blend in variable proportions of extracts derived from non-hydrogenated coal on the one hand and substantially hydrogenated coal on the other hand can be identified and then employed to achieve selective anisotropicity of the graphite on a commercial scale.

DETAILED DESCRIPTION OF THE INVENTION

Starting Coals & Preliminary Preparation

Figure 1:
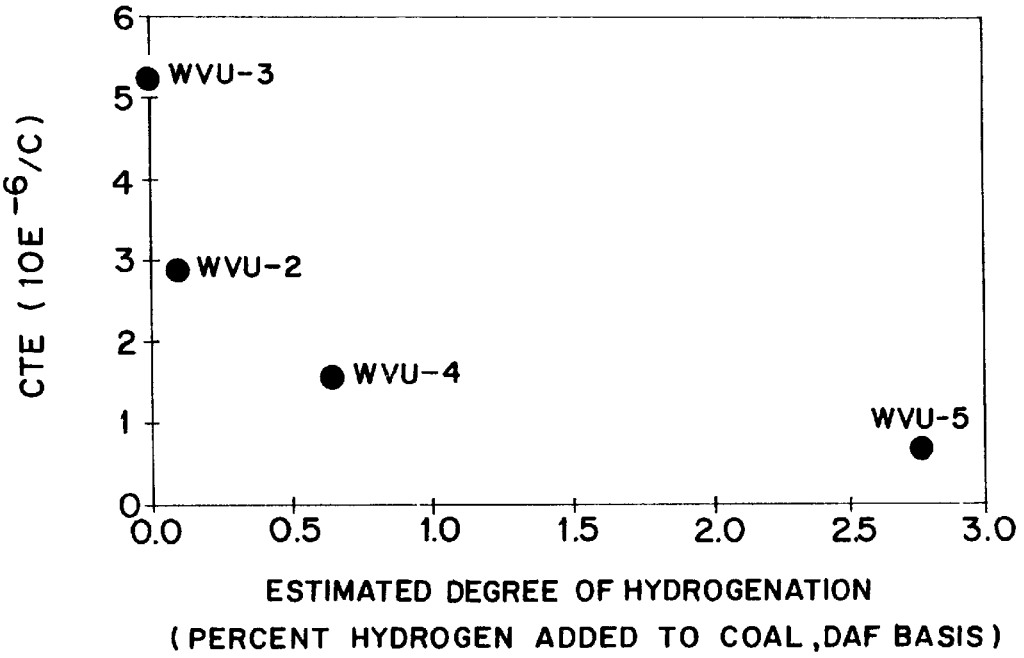
FIG. 1 is a plot of the relationship of the CTE, as an indicator of the extent of anisotropicity, of selected graphite samples, as identified, and an estimated degree of hydrogenation applied to the starting coals from which such graphites were produced by the processing of the invention.

Seven different coals of bituminous rank from West Virginia were obtained from the West Virginia Geological Survey, bituminous coals of any reasonably good grade having been found suitable for the basic extraction procedure. The Geological Survey designation number together with important characteristics of each of these different coals is set forth in the following Table 1.

TABLE 1

| WV Geologic Designation | WVGS 13407 | WVGS 13421 | WVGS 13422 | WVGS 13423 |
|---|---|---|---|---|
| Coal Bed | Bakerstown : | Powellton | No. 2 Gas Coal | Lower Powellton |
| County | Barbour | Raleigh | Raleigh | Mingo |
| State | West Virginia | West Virginia | West Virginia | West Virginia |
| ASTM rank | hvAb | mvb | hvAb | hvAb |
| Mean-Maximum reflectance of vitrinite | 1.059 | 1.111 | ND | 1.002 |
| Proximate Analysis (as received) | | | | |
| Moisture | 0.68 | 0.98 | 0.80 | 0.82 |
| Fixed Carbon | 55.15 | 67.87 | 65.85 | 60.49 |
| Volatile Matter | 28.23 | 27.96 | 26.88 | 34.41 |
| Ash | 15.94 | 3.19 | 6.46 | 4.27 |
| Petrographic Composition (% volume) | | | | |
| Vitrinite | 59.6 | 63.3 | 48.1 | 71.4 |
| Exinite | 3.9 | 5.7 | 5.4 | 5.5 |
| Inertinite | 27.0 | 30.0 | 43.0 | 21.7 |

| WV Geologic Designation | WVGS 13424 | WVGS 13425 | WVGS 13426 |
|---|---|---|---|
| Coal Bed | Powellton Upper Split | Powellton Lower Split | Lower No. 5 Block |
| County | Mingo | Mingo | Kanawha |
| State | West Virginia | West Virginia | West Virginia |
| ASTM rank | hvAb | hvAb | hvAb |

TABLE 1-continued

| | | | |
|---|---|---|---|
| Mean-Maximum reflectance of vitrinite | 1.016 | 1.047 | ND |
| | Proximate Analaysis (as received) | | |
| Moisture | 0.81 | 1.29 | 1.44 |
| Fixed Carbon | 56.06 | 61.99 | 56.84 |
| Volatile Matter | 30.79 | 30.53 | 33.68 |
| Ash | 12.34 | 6.19 | 8.04 |
| | Petrographic Composition (% volume) | | |
| Vitrinite | 47.1 | 74.4 | 40.2 |
| Exinite | 11.2 | 6.6 | 16.1 |
| Inertinite | 34.5 | 14.6 | 38.4 |

ND = not determined

In the rank designation, "mvb" designates a medium volatile bituminous coal while "hvAb" designates a high volatile A bituminous coal.

The coal samples, freshly mined as lump coal, were held in nitrogen-filled plastic bags until ready for grinding. They were ground without drying into two sized fractions of 100 and 200 mesh to size (Tyler scale) without drying before being returned to nitrogen-filled containers from which approximately 5 pounds samples were taken and sealed in a nitrogen atmosphere in plastic bags to preclude any oxidation and these bags were stored in a cold room at about 4° C. until ready for use. Just prior to the intended treatment, e. g. extraction, the samples were removed from the bags and dried in a vacuum oven at about 110° C. for about 24 hours under a nitrogen purge to insure a bone-dry condition.

NMP-Type Solvent Extraction

The extraction behavior of these coals was evaluated by means of laboratory scale experiments. For such experiments, 10 grams of dried, ground coal was placed in a flask equipped with a condenser, stirrer and nitrogen purge. 100 ml of freshly distilled N-methyl pyrrolidone (NMP) was added to the flask, the stirrer was activated and heating commenced until the mixture reached boiling point of 202 C. Refluxing continued at this temperature for one hour and then the solid and liquid fractions of the coal were separated by filtration in a traditional Buchner filtration apparatus, the undissolved matter being retained on filter paper and the filtrate of extracted coal in NMP collected. The extracted matter was freed of solvent in a rotary evaporator operated under reduced pressure and finally dried over night in a vacuum oven at 150° C. under flowing nitrogen. When cooled to RT, the solid matter was recovered and weighed. The NMP was recovered by condensation for re-use. The yields obtained are compared in the following Table 2.

TABLE 2

NMP Solvent Extraction Yields from Seven Coals

| Coal | WVGS 13407 | WVGS 13421 | WVGS 13422 | WVGS 13423 | WVGS 13424 | WVGS 13425 | WVGS 13426 |
|---|---|---|---|---|---|---|---|
| Yield wt % | 66.3 | 35.7 | 25.0 | 32.2 | 27.7 | 25.0 | 21.4 |

One will observe from Table 2 that, with one exception, the amount of extracted coal, i. e. that was dissolved by the NMP, from the different samples varied significantly even for coals of the same rank designation, ranging from about 20 to 35%. The exception was WVGS 13407, a Bakerstown coal, which yielded roughly double the amount of extracted coal as the others. No explanation for the latter strong divergence in results has yet been found.

While all of the extraction values represent useful levels, it was decided that the Bakerstown coal plus the coals with the next two best yields would be selected for further experimentation with priority being initially given to the Bakerstown coal. To permit the recovery of more practical-sized fractions, a glass extractor unit having a capacity of 12 liters and capable of handling about 2–3 pounds of dried coal was constructed and utilized in the same manner described above. Then, for even greater capacity, a 25 liter extractor reactor was constructed from a vertical metal cylinder of about 1' in diameter and almost 3' in height closed at the bottom. An electrically operated stirrer for mixing was fitted through the top and a band heater was wrapped at three levels around the cylinder exterior for heating. To condense and return the boiling solvent, a reflux condenser was added. This unit readily handled 2 to 3 pounds of coal in 20 to 25 liters of solvent and was used for the two lower yield coals.

With a view to accelerating the separation of solids from the filtrate, a combination of centrifugation in one liter centrifuge vessels at 4000 rpm for one hour followed by decantation of the liquid fraction and filtration through 1–2 micron filter paper, after which excess NMP removed in a rotary evaporator and finally by drying at 150° C. under vacuum, was adopted for WVGS 13421 processing. Later when experience proved that ash removal was achieved just as effectively by centrifugation alone rather than the above combination, filtration was dispensed with.

As noted, the extraction procedure employed NMP as the extraction solvent. However, other solvents can be substituted and reference is made in this connection to the disclosures set forth in both the above-identified patent to Stiller et al as well as our pending application also identified above both of which set forth both class definition and several examples of the operative group of solvents useful for the present invention and such disclosures are incorporated by reference herein in their entirety. In the interests of simplification and brevity, the class of extraction solvents will be referred to herein as "NMP-type solvents" and it will be understood that the latter phrase is intended to embrace the full class of solvents defined in the above sources and that where NMP is mentioned as such in this specification, it is done so by way of example only.

Hydrogenation

In the belief that hydrogenation of the coal prior to solvent extraction might improve the extraction efficiency, i. e. the yield of extract, and perhaps alter the properties of the recovered extracted material, hydrogenation was undertaken in a tetralin (tetrahydro naphthalene) medium, tetralin being selected because it was deemed a reasonably effective proton-donor solvent for hydrogenation. While tetralin has little solvent action on coal at room temperature, at hydrogenation temperatures, it does solvate the coal to a varying degree dependent on the particular coal. Other proton-donating solvents could presumably be substituted for tetralin, including highly aromatic high-boiling recycle solvents of so-called hydrogen shuttling solvents. For hydrogenation, coal needs to be at a temperature at which the coal is softened or thermally decomposed even when in finely ground condition, usually at least about 300° C. and in general a temperature range of about 350–450° C. is preferred. Temperatures much above 450° C. carry a risk of excessive degradation of the coal. The severity of the hydrogenation in general increases with increasing temperature within this range.

Small scale hydrogenation experiments were carried out initially with the WVGS 13407 Bakerstown coal, using a 1000 ml Parr autoclave equipped with a stirrer giving an effective product capacity of about 150 gm. For these, the reactor was loaded with 200 gm ground dry coal along with 600 ml of tetralin, sealed, purged with nitrogen gas, charged with hydrogen gas at 1000 psi (cold starting pressure) and then heated to 350 C and held there for one hour. The reactor was then allowed to cool to room temperature, vented to relieve pressure, and the contents flushed with NMP into a receptacle and diluted with additional NMP to form a low-viscosity slurry. The slurried mixture was heated to boiling for a time, then filtered on a 1–2 micron filter paper, and the filtrate was evaporated in a rotary evaporator to remove any residue of the solvents and the remaining solid matter dried under vacuum overnight at 150° C. The product of several runs was combined for further processing, In later experiments, a one gallon bolted closure autoclave available from Autoclave Engineers, of Erie, Pa., equipped with a Magna-drive stirrer controlled to operate at 1000 rpm and having a controllable three-zone heating furnace was utilized. This allowed for a capacity of about 500 gms dried ground coal in 2 liters of tetralin. After loading, the autoclave was purged with hydrogen gas bubbled through the contents and initially pressurized to 1000 psi (cold) except when the reaction temperature was to reach 450° C. in which instance the starting pressure was reduced to 800 psl. Heat was then applied with stirring and working temperature was reached in 2–4 hours. Once attained, reaction temperature was held for one hour after which heating was terminated and the reactor allowed to cool which typically required several hours. Residual pressure was carefully released, allowing the reactor to be opened and the contents transferred to a rotary evaporator for removal of tetralin.

Consumption of hydrogen to give an estimate of the extent of hydrogenation of the coal was determined by detecting by chromatography the relative amounts present of tetralin vs. naphthalene at the start and at the end. It was theorized, and is the general view in the art, that tetralin is the operative source of hydrogen atoms during the hydrogenation, rather than the hydrogen gas in the reaction atmosphere. As revealed by its chemical name, tetrahydro naphthalene, tetralin converts to naphthalene with the loss of four hydrogen atoms which are in the "free radical" state and thus preferentially reactive with the coal, the amount of hydrogen consumed from the reaction atmosphere being insignificant in comparison. Thus, by detecting the quantity of naphthalene generated as a by-product during hydrogenation, the quantity of hydrogen lost from the tetralin to the coal is easily calculated from which the degree of hydrogenation could be estimated.

In view of the operative mechanism for introduction of added hydrogen into the coal, it is believed that increase in the hydrogen gas pressure during hydrogenation would not have any significant effect on the degree of hydrogenation. The function of the hydrogen gas pressure is to maintain the correct phase equilibrium for the reaction system rather than to take a reactive role in the hydrogenation. On the other hand, increases in the time of reaction might well have some influence on the degree of hydrogenation although this has not up to now been confirmed.

Estimated hydrogen consumption for two coal samples is given in the following Table 3 for three hydrogenation temperatures. As the table shows, coal-hydrogen reactivity is a function, inter alia, of coal rank as well as temperature. Broadly speaking, a lower rank coal is expected to exhibit greater hydrogenation activity than a higher rank coal.

TABLE 3

Estimated Hydrogen Consumption for Two Coals As a Function of Hydrogenation Temperature

| | WVGS 13421 | | | WVGS 13423 | | |
|---|---|---|---|---|---|---|
| Hydrogenation Temp. ° C. | 350 | 400 | 450 | 350 | 400 | 450 |
| Hydrogen consumption wt % dry, ash-free coal (daf) - | <0.01 | — | 2.77 | 0.10 | 0.64 | 2.91 |

As expected, hydrogenation of the coal prior to extraction did substantially increase the amounts of coal that could be extracted with NMP solvent. This is revealed in the following Table 4.

TABLE 4

NMP Extraction Yields of Three Coals After Hydrogenation

| | Coal | | | | | | |
|---|---|---|---|---|---|---|---|
| Hydrogenation | WVGS 13407 | WVGS 13421 | | | WVGS 13423 | | |
| Temp. ° C. | 350 | 350 | 400 | 450 | 350 | 400 | 450 |
| Yield, Hyd, Coal wt % (daf) | 84 | 63 | 83 | 82 | 74 | 83 | 67 |
| Yield, Raw Coal wt % (daf) | 66.3 | | 35.7 | | | 34.2 | |

Generally speaking, mass balances of recoverable materials were within expected experimental limits, i. e. between 78 and 95 wt %, with the exception of the WVGS 13423 coal when hydrogenated at 450° C. As the value for this coal at this temperature in Table 4 indicates, a significant drop in product yield occurred which was reflected in the mass recoverable at a value of barely 70 wt %. From gas chromatographic analysis and visual inspection of collected materials, it was deduced that highly hydrogenated products of this coal were highly volatile, becoming distilled off, and not recoverable.

Elemental analysis of extraction products with and without hydrogenation throws some light on the effect of hydrogenation on the relative chemical makeup of the extraction products, as shown in the following Table 5.

TABLE 5

Elemental Analysis of NMP Extracts of WVGS 13407 Coal Before and After Hydrogenation at 350° C. (%)

| Element | Raw Coal (daf) | NMP-Extract | NMP-Extract Coal Hydrog. at 350° C. |
|---|---|---|---|
| C | 85.9 | 85.2 | 85.5 |
| H | 5.43 | 5.7 | 6.15 |
| N | 2.3 | 2.3 | 2.75 |
| S | 0.80 | 1.3 | 0.54 |
| O* | 5.57 | 5.5 | 5.0 |
| C/H atomic | 1.32 | 1.25 | 1.16 |

*Oxygen by difference

The results of a comparison of the elemental composition of NMP extracts of another coal, i. e. WVGS 13407, with and without hydrogenation at 350° C. were comparable, as appears in Table 6 below.

TABLE 6

Elemental Analysis of NMP Extracts of WVGS 13421 Coal Before and After Hydrogenation at 350° C. (%)

| | Raw Coal | | NMP-Extract Coal Hydrog. at | |
|---|---|---|---|---|
| Element | (daf) | NMP-Extract | 400° C. | 450° C. |
| C | 86.07 | 84.24 | 87.0 | 88.11 |
| H | 5.26 | 5.47 | 5.49 | 5.83 |
| N | 1.51 | 0.77 | 0.68 | 0.78 |
| S | 9.87 | 0.77 | 0.68 | 0.78 |
| O* | 6.29 | 7.44 | 4.39 | 3.06 |
| C/H atomic | 1.37 | 1.28 | 1.32 | 1.26 |

*Oxygen by difference

The effect on softening behavior of one coal, namely WVGS 13421, of NMP extraction with and without hydrogenation of the coal is shown in the following Table 7.

TABLE 7

Softening Behavior of NMP Extraction of WVGS 13421 Coal with and without Hydrogenation

| | NMP EXTRACTION | AFTER HYDROGENATION | |
|---|---|---|---|
| | ALONE | @ 400° c. | @ 450° c. |
| Glass Transition Temp. ($T_g$) ° C. | — | 168[1] | 76[2] |
| Mettler Soft Point ° C. | >300 | 173 | 158 |

[1]By thermal mechanical analysis
[2]By DSC

The above thermal properties demonstrate the pitch-like nature of the NMP extraction products of hydrogenated bituminous coals although one knowledgeable in the graphite field will appreciate that the above softening temperatures are significantly higher than comparable softening temperatures of the commercially available coal tar binding pitches and impregnating pitches employed in graphite production. It should also be pointed out that failure to remove residual NMP solvent from the extraction products has a rather profound plasticizing effect on the hydrogenated extraction products. For example, failure to remove residual NMP from the extract obtained from the coal subjected to hydrogenation at 400° C. lowers the glass transition temperature, as determined in the same manner, from 168° C. specified above to 98° C.

The extraction products are moreover distinguished from conventional coal tar pitches in chemical respects in that conventional coal tar pitches typically have over 85% of the hydrogen atoms therein bonded to aromatic carbon whereas the extraction products of the invention has a high content of aliphatic hydrogen, as illustrated by the NMP extracts of WVGS 13407 without hydrogenation where the aliphatic hydrogen content was 71% and of WVGS 13421 after hydrogenation at 450° C. where the aliphatic hydrogen content was 61%.

Heat Treatment Conditions for Graphite Production

In general, the heat treatment conditions utilized in the several stages involved in graphite productions are in all essential respects comparable to those typically employed in the art for that purpose. Details are given in our pending patent application Ser. No. 08/302,481, identified above, to which reference may be had. The particular combinations of thermal conditions employed in the experimentation related to this invention are described below.

a. Carbonization to Form Green Coke

For carbonization, two different tubular coking reactors were employed for producing green coke. In one instance, a pipe about 2.5' in length and 2" ID of heavy carbon steel was machined at its ends for fitting of sealing plugs. The pipe was loaded to about ⅔'s capacity with a known amount of extracted coal, flushed with nitrogen gas, and sealed. The resultant coking tube was inserted into a ceramic tube furnace and heated in two stages. In the first stage, the tube was heated to 400° C., at which the contents became a molten mass with evolution of some volatiles, and held at this temperature for 12 hours. Then the contents were heated to 600° C. and held for one hour. After cooling to RT, the tube was opened, the contents removed and weighed.

In the other instance, a somewhat larger capacity reactor was devised from a 10" length of 7" diameter steel pipe closed at one end by a welded steel pipe and fitted at the other end with a boltable closure plate. In a typical test, 250 to 500 gm of extracted coal was loaded into the unit, sealed under nitrogen and inserted into a temperature programmable furnace. The heating program followed the following temperature progression: increased 5° C./min to 350° C., then 1 C/min to 425° C., 425° C. held for 90 min, increased 3° C./min to between 500 to 600° C., and held there for 3 hours. Finally, the reactor was allowed to cool to RT and the contents recovered for weighing.

The influence of hydrogenation of the coal prior to NMP extraction is shown in the following Table 8 in comparison with the results of thermo gravimetric analysis (TGA) involving rapid heating up to 600° C. under a flowing inert atmosphere. The values are percentages of the starting extracted material, either hydrogenated or not as specified.

TABLE 8

Change in Green Coke Yields from NMP Extracted Coals with Hydrogenation

| Coal | Green Coke Yield | TGA Yield |
|---|---|---|
| WVGS 13407 | | |
| No Hyd. | 71.4 | 71.0 |
| Hyd. 450° C. | — | 60.3 |
| WVGS 13421 | | |
| No Hyd. | 71.2 | 80.0 |
| Hyd. 400° C. | 62.8 | — |
| Hyd. 450° C. | 57.1 | 51.0 |
| WVGS 13423 | | |
| No Hyd. | 70.3 | 61.5 |
| Hyd. 450° C. | 52.3 | 34.0 |

It is evident that hydrogenation of the coal before NMP extraction caused a significant reduction in the yield of green coke as well generally speaking in the yield by TGA. One can surmise that sealing of the material during green coking favored a reaction of evolved species with components of the molten residue along the lines of polymerization and re-condensation reactions that would increase carbon yield.

b. Calcination

The green cokes obtained from the above treatments were converted into calcined cokes by loading a known quantity of a given green coke within an alumina tube fitted at opposite ends with end caps allowing a continuous purge by nitrogen. The loaded tube was placed within a high temperature furnace and heated to 1000° C. for 30 to 60 min after which the furnace was cut off, allowed to cool to RT, opened and the contents recovered for weighing of the calcined coke.

In contrast to the behavior of green cokes, whether the extract was derived from coal which had been hydrogenated or not had little influence on the yield of recovered product, Indeed, hydrogenation appeared to result in slightly larger yields, as a percentage of the green coke being calcined, as seen in Table 9 below.

TABLE 9

Yields of Calcined Coke from NMP Extracts with and without Hydrogenation of the Coal

| Coal | Calcined Coke Yield (wt % of green coke) |
|---|---|
| WVGS 13421 | |
| No Hyd. | 92.8 |
| Hyd. 400 | 93.8 |
| Hydr. 450° | 94.2 |
| WVGS 13423 | |
| No Hyd. | 87.0 |
| Hyd. 450° | 92.0 |

As noted, the above values as expressed as a percentage by weight of the green coke. The following Table 10 gives coke yields for several coals expressed in terms of the actual starting or feed coal on a dry ashfree basis.

TABLE 10

Calcined Coke Yields from NMP Extracts With and Without Hydrogenation, as Percent of Feed Coal

| Coal | Green Coke Yield | Calcined Coke Yield |
|---|---|---|
| 13407 | | |
| No Hyd. | 47.3 | — |
| Hyd. 350° | 50.7 | — |
| 13421 | | |
| No Hyd. | 25.4 | 23.6 |
| Hyd. 400° | 52.1 | 48.9 |
| Hyd, 450° | 45.8 | 44.1 |
| 13423 | | |
| No Hyd. | 24.0 | 20.9 |
| Hyd. 450 | 35.0 | 32.2 |

c. Graphitization

In preparation for graphitization, the selected calcined cokes were initially milled into fine flour so that about 50% passed through a 200 mesh Tyler screen. The coke flour was mixed in a ratio of 100/34 parts by weight with a standard commercially available coal tar binder pitch (110° C. softening point) in fused condition at about 155° C., using a ratio of coke to binder pitch of 100/34 parts by weight. The mixed blend was transferred to the mud cylinder of an extrusion press heated at about 120° C. and extruded therefrom in the form of cylinders or green rods 15 cm in length and 19 mm in diameter. The green rods were packed in coke and baked in saggers to 800° C. at a heating rate of 60° C. per hour. The baked rods were then placed in a graphite tube furnace and graphitized to about 3000° C. For the measurement of CTE, the graphite rods were machined into cylinders.

Determination of the ash content of calcined cokes and analysis of the ash showed that the levels of contaminants in both the green and calcined cokes, particularly metallic contaminants, was higher than would be desired for commercial graphite production, based on analysis of representative commercial graphites. This contamination was attributed to pick-up of metallic constituents form metallic laboratory reaction vessels employed for example for carbonization and calcination which could presumably be reduced by modification of the vessel construction. With a view to reducing such contaminations, acidic washing with a mild 6M solution of hydrochloric acid of both the green and calcined cokes was evaluated and found to in fact achieve a significant reduction in such contamination.

Furthermore, analysis of the final graphite samples demonstrated that graphitization effects a profound reduction in ash content due to the volatilization of ash constituents at the extreme high temperatures required for graphitization. With only rare exceptions, graphitization reduced ash content by 90% or more and even in the worst case, the reduction was about 65%. Generally speaking, the better of the samples showed ash levels roughly comparable to those of commercial nuclear grade graphites which are presumed to have undergone an expensive chlorine purification that was not applied to the inventive samples.

As already suggested, the CTE values of the ultimate graphites is an important characteristic in indicating the isotropicity/anisotropicity of the graphites, which again is a prime factor, as noted in the beginning in determining the particular end use for which a given graphite is acceptable. For CTE measurement, use was made of the capacitance bridge method over a temperature range of 25 to 100° C.

Effect of Hydrogenation on Anisotropicity of Graphites

From the CTE values obtained for the graphites obtained from the NMP extracts derived from coals which had been hydrogenated under conditions giving different consumptions of hydrogen, estimated in the manner described above, it was evident that from a substantially isotropic (i. e. essentially non-anisotropic) behavior for the graphite which had not been hydrogenated (i. e. hydrogen consumption= 0%), increase in hydrogen consumption generally corresponded with increase in anisotropicity. This relationship can be seen in FIG. 1 for the coals WVGS 13407 and WVGS 13421 taken together. In particular, the coal having a consumption of hydrogen during hydrogenation approaching 3.0 wt % had a CTE well below 1, namely, 0.71, which was considered to clearly denote a highly anisotropic graphite.

Based on even the limited hydrogenation data that was accumulated, as seen in FIG. 1, and without comparable data for the same coal or coals, for which the necessary testing has not yet been carried out, it is evident that the course of the hydrogenation reaction is peculiar to virtually each type, i. e., vein, of bituminous coal and may even be peculiar to the "same" coal taken from different regions of the same vein. This conclusion is a logical consequence even without complete supporting data from the randomness of natural coals as is common knowledge in the coal industry. Hence, each coal can be expected to have its own specific "hydrogenation curve", i. e. the relationship of change in CTE, and thus change in anisotropicity, in both its calcined coke and graphite forms with degree of hydrogenation, as indicated, for example by consumption of hydrogen during hydrogenation.

It is impractical therefore to postulate a "generic hydrogenation curve" (or relationship) that would be applicable to all bituminous coals even a number of bituminous coals. In practice, as far as can now be stated, one would take the approach of evolving a hydrogenation curve for each given coal by subjecting that coal to hydrogenation over a range of temperatures, take samples at each of several different temperatures, process such samples into calcined coke or more preferably graphite, measure the CTE's of such samples as an indicator of anisotropicity, and compare the results of these measurements, e. g. in the form of a curve as in FIG. 1, in order to identify the precise "hydrogenation curve" for that coal. From that comparison, one would be able to select that set of hydrogenation conditions that should be applied to the coal in question in order to achieve a graphite possessing a desired degree of anisotropicity ranging from substantially isotropic to highly anisotropic including the various levels in between.

Those knowledgeable in the field of graphite will appreciate that identification of isotropicity/anisotropicity can be done in ways other than CTE measurement, for example, by microscopic observation of samples of the graphite (or for that matter, calcined coke) in that the extreme states of isotropicity and anisotropicity are characterized by grain configurations which can be readily perceived and identified by microscopic evaluation as well as intermediate states which can be approximated by extrapolation.

It should also be acknowledged that the hydrogenation reaction can proceed beyond the limits of hydrogen consumption mentioned above and can therefore result in degradation of the coal beyond what is desirable or advantageous for the present invention. Data presented above already shows that although the yields of the NMP extract tends to be increased by hydrogenation, the yields of the ultimate graphite is reduced with increasing degree of hydrogenation. This loss in yield is presumably a consequence of degradative attack on the coal during hydrogenation whereby more highly volatile by-products are generated and become lost during the heat treatments for graphitization. One can reasonably suppose that the identification of the desirable end point of hydrogenation will involve a balancing on a practical basis of a desirable increase in anisotropicity vs. an economically unacceptable decrease in graphite yield and that this "equilibrium point" will likely be specific to each coal and is to be determined for each coal.

Obviously, an acceptable end point for the hydrogenation of any of the bituminous coals can be established experimentally by trial and error. Samples of the coal can be taken at different levels of hydrogenation and processed into calcined coke or graphite and the degree of anisotropicity determined. In addition, to provide points of reference denoting the extremes or end points of hydrogenation behavior considered to be common to bituminous coals generally for purposes of this invention, a coal that has been hydrogenated sufficiently to be capable of producing a highly anisotropic calcined coke or ultimate graphite will take on a pitch-like plastic condition when warmed and will produce when extracted with NMP and solidified essentially free of extraction solvent a solid extract which exhibits a Mettler softening point <150° C. and an absolute viscosity of approximately 100–200 poises at 160° C. Consequently, the latter properties can be utilized to determine a suitable end-point of hydrogenation of a coal to give an NMP extract which when further processed according to the appropriate steps described herein yields a highly anisotropic calcined coke or graphite. In contrast, an NMP extract, after solidification essentially free of solvent, of a coal (e. g. non-hydrogenated) that is capable of producing a substantially isotropic calcined coke or ultimate graphite exhibits a Mettler softening point >300° C. and an absolute viscosity >10,000 poises at 330° C. The absolute viscosity values are determined according to the standard ASTM procedure and are independent of any particular viscosimeter employed therein, e. g. a Brookfield viscosimeter. Similarly, the Mettler softening points are determined in the recognized manner. The need for removal of residual extraction solvent prior to measuring these characteristics should not be overlooked because the present of residual solvent significantly alters the softening behavior as already noted.

Effect on Anisotropicity of Graphites of Combining Non-hydrogenated and Highly Hydrogenated Coals in Selected Proportions The availability of calcined cokes that were substantially isotropic at one extreme and highly anisotropic at the other extreme, and capable of yielding correspondingly different graphites, led to a recognition of the possibility of varying or selecting the degree of anisotropicity between these extremes by combining of an NMP extract derived from a (e. g. non-hydrogenated) coal capable of yielding a highly isotropic graphite with an extract of the same (or similar) or even conceivably a different coal modified, e. g. by suitably extensive hydrogenation, to a capability of yielding a substantially anisotropic graphite in a range of different proportions varying in the broadest sense from 100/0 pts by wt at one extreme up to 0/100 pts by wt at the other extreme. At each of the end limits, i. e. 100/0 and 0/100, only one of the extracted fractions is present and constitutes 100% of the sample, the other being excluded. Hence, there obviously cannot be any "blending", in the literal sense of the word, of the samples at the end limits. For samples falling in between the end limits, where both of the two extracted fractions are present, blending of the two fractions does take place and it is important that such blending be carried out while the extracted fractions are in solution so that when the extracted solids are recovered, they are in the form of a solution blend and are at least essentially molecularly homogeneous.

Figure 2:
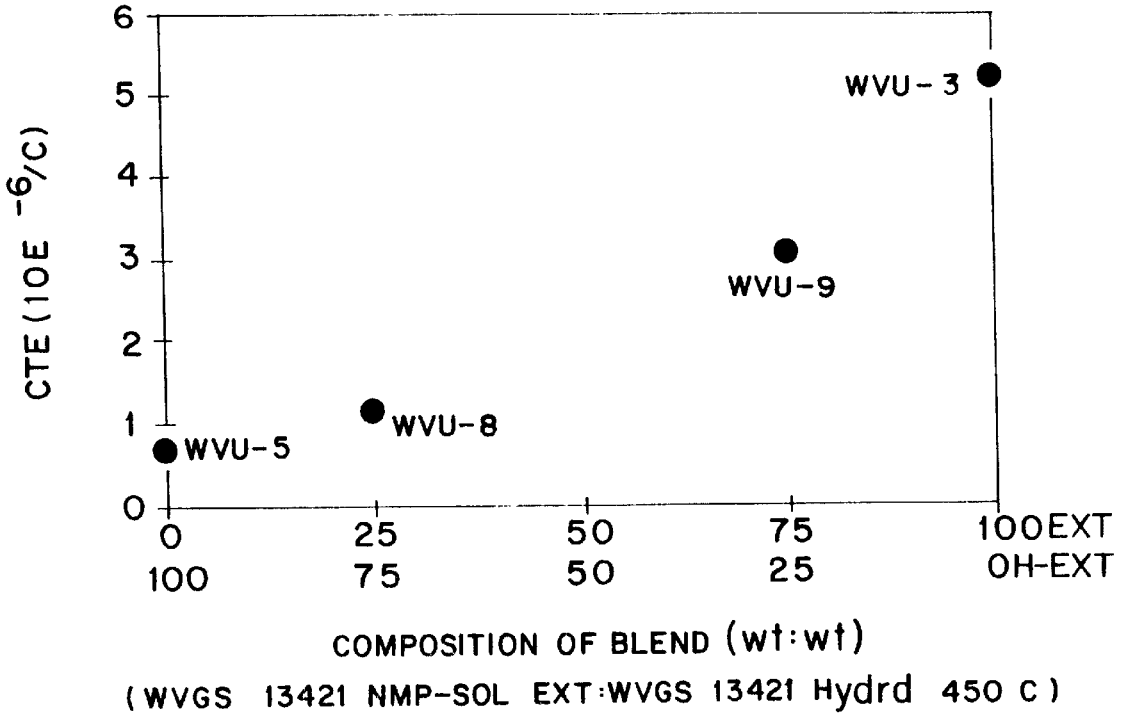
FIGS. 2 and 3 are similar plots of the relationship of the CTE, as an indicator of the extent of anisotropicity, of selected graphites, as identified, and the relative proportions in solution blends of NMP-extracted solids derived respectively from non-hydrogenated and substantially hydrogenated forms of each of two different bituminous coals.
Figure 3:
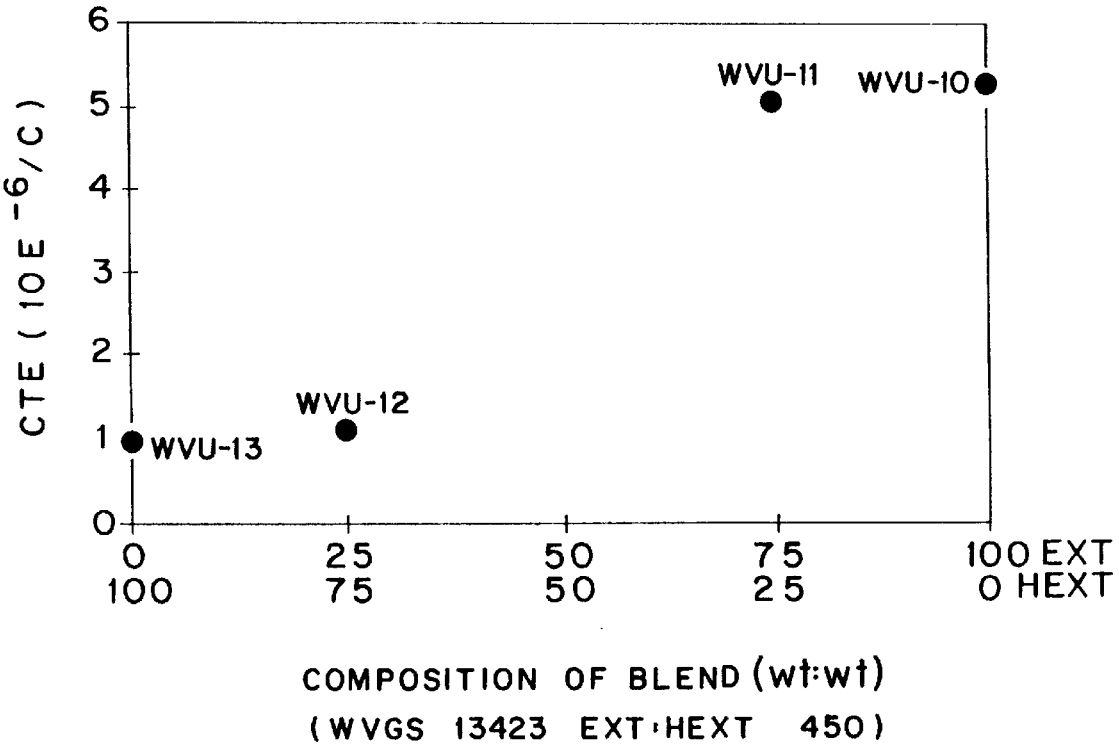

The results of tests combining two coal NMP-extracts, namely WVGS 13421 and 13423, non-hydrogenated (i. e. substantially isotropic-tending) and hydrogenated at 450° C. (highly anisotropic-tending) in each case at several proportions from 100/0 to 0/100 pts by wt are shown in FIGS. 2 and 3. These tests were carried out by taking already prepared NMP extracts of the respective non-hydrogenated and hydrogenated coals and combining or blending them together in the selected proportions. As an example, for a 75/25 blend of WVGS 13421, 1.125 lbs of the NMP extract of this coal, derived from the raw coal, was mixed with 0.375 lbs of the NMP extract of the same coal derived after hydrogenation at 450° C. and the resultant 1.5 lbs of mixture was placed in a 10 liter vessel to which was added about 7 liters of NMP. This mixture was heated with agitation at 140° C. for about 1 hour or until complete dissolution had taken place. Then, excess NMP was removed by rotary evaporation, the product recovered and dried in a vacuum oven at 150° C. overnight to insure removal of the NMP. If more material was required for further experimentation, the sequence was repeated until enough of the product had been accumulated. The final dried product was loaded into a nitrogen-purged container, sealed in plastic bags and stored under refrigeration until needed for further processing or testing.

Although actual evaluation has not up to now been carried out, it is presumed that separate extraction of the respective extracts is not a prerequisite and that the same end result of a solution blended product can be attained by a common NMP extraction of a combination of the raw and hydrogenated coals, either as a pre-prepared physical mixture or by in situ admixture during the extraction, in proper proportions to achieve the desired proportions in the final blended product. Under such circumstances and employing a sufficient amount of NMP-type solvent for the common dissolution, a solution blend comparable to that resulting from the separately extracted coals will be obtained without proceeding through the separate extraction steps for the two starting materials. Here again, it will be understood that for samples constituted entirely of one or the other of the raw or hydrogenated coals to define the end limits of the range of combinations, there is obviously no blending of the two different coals together.

The common extraction step does suffer from the disadvantage compared to the individual extraction steps of a more complicated determination of the correct amount of the starting materials. In the case of individual extraction, the respective extracts can simply be combined in the desired proportions whereas in the case of a common extraction, some preliminary testing would be required to determine the expected yields to be derived from the starting material so that the starting amounts could be adjusted as required to end up with a composition combining the respective extracted fractions in the desired proportions. But apart from this practical complication attendant the common extraction approach, the two approaches are deemed to be fully equivalent.

Whether the final NMP extraction products of the invention are obtained by means of separate extraction of the respective coals separately or a common extraction of the respective coals together, the result for extraction products containing both of the extracted fractions is a "solution blend" in which the molecules of the respective extracted materials are homogeneously combined in a single homogenous solution phase. Such a condition can be definitely differentiated from a physical mixture of calcined cokes of different degrees of anisotropicity combined together even where such cokes are in a fine state of subdivision, i. e. fine powdered form, when mixed together. Under the latter circumstances, localized dis-homogeneities necessarily exist and persist into the final graphite. In contrast, the blends of the invention form an "ideal" solid molecular dispersion such as is referred to in physical chemistry as "solid solutions" in which the different "solutes" are mutually dissolved in one another. As is commonly recognized, "solid solutions" are characterized by properties which are distinct from comparable properties of the respective components, as, for instance, a "solid solution" of salt and water has a different and lower freezing/melting point from fused salt and liquid water separately which explains why salt can be employed to preventing icing of precipitation on streets and like surfaces under temperature conditions where icing would otherwise take place.

It is evident from FIGS. 2 and 3 that the two coals illustrated there exhibit significantly different behavior in terms of the effect on CTE values when the non-hydrogenated and hydrogenated extracted fractions are combined in different proportions over the range of 100/0 to 0/100 pts/wt. It is believed that just as virtually each coal has its own "hydrogenation curve", virtually each coal (or mixes of coals) will have its own. "blending curve" so that the effect on anisotropicity of changing the different proportions of the hydrogenated and non-hydrogenated extracted fractions over the range will be special for each kind of bituminous coal or mixes of two such coals should they be different. Consequently, each kind of starting coal will need to be preliminarily evaluated over a full range of proportions of 100/0 to 0/100 pts/wt as illustrated in FIGS. 2 and 3 to establish its characteristic blending curve from which the conditions needed to achieve a desired degree of anisotropicity from substantially anisotropic isotropic to highly anisotropic with a production run for that coal can be selected with reasonable accuracy.

In theory, the limits of the selected degree of anisotrophy for production runs are 100/0 and 0/100. But in the case of runs at the extreme limits of 0/100 and 100/0 pts/wt, there would rarely be reason to utilize the concept of the invention in testing other samples over the remainder of the range between these limits to define a full blending curve. Hence, more practical limits for the application of the invention for the selection of proper proportions for a given production run can range from 95/5 to 5/95 or perhaps from 90/10 to 10/90, all in pts by wt.

Graphites Illustrative of the Invention and Selected Properties Thereof

Some 13 different graphites were prepared in accordance with this invention and evaluated as to selected relevant properties. These graphites are identified by "WVU #" in the following Table 11 with their respective derivations noted in terms of the starting coals and the particular "pitches" employed as starting materials for the production of these graphites, the term "pitch" serving as a synonym for an NMP solvent-extracted extract by virtue of the visual similarity of such extracts with conventional coal tar and petroleum derived "pitches" known in the graphite field. To explain the abbreviations appearing in Table 11: the term "EXT" denotes an NMP extract from raw or non-hydrogenated coal while the term "HEXT" denotes an hydrogenated coal at an hydrogenation temperature specified by the immediately following three digits, for example "HEXT 350° stands for an extract obtained from a coal hydrogenated at 350°. The "blend" values denote the proportions used for making the blend from the indicated sources of the extracts used for the blend. For example, "Blend 60:40 wt %–EXT:HEXT 350" stands for a solution blended extract of 60% by wt of an extract of non-hydrogenated coal with 40% by wt of an extract of coal hydrogenated at 350°.

TABLE 11

Pitch Identification and Corresponding Graphite Produced from that Pitch

| Graphite | WVU-1 | WVU-2 | WVU-3 |
|---|---|---|---|
| Pitch Source | WVGS 13407 NMP-Soluble Extract (EXT) | WVGS 13407 Hydrogenation 350° C. (HEXT350) | WVGS 13421 NMP-Soluble Extract (EXT) |
| Graphite | WVU-4 | WVU-5 | WVU-6 |
| Pitch Source wt % | WVGS 13421 Hydrogenation 400° C. (HEXT400) | WVGS 13421 Hydrogenation 450° C. (HEXT450) | WVGS 13421 Blend 75:25 EXT:HEXT400 |
| Graphite | WVU-7 | WVU-8 | WVU-9 |
| Pitch Source wt % | WVGS 13421 Blend 60:40 wt % EXT:HEXT350 | WVGS 13421 BLend 25:75 wt % EXT:HEXT450 | WVGS 13421 Blend 75:25 EXT:HEXT450 |
| Graphite | WVU-10 | WVU-11 | WVU-12 |
| Pitch Source wt % | WVGS 13423 NMP-Soluble Extract (EXT) | WVGS 13423 Blend 75:25 wt % EXT:HEXT450 | WVGS 13423 Blend 25:75 EXT:HEXT450 |
| Graphite | WUV-13 | | |
| Pitch Source | WVGS 13423 Hydrogenation 450° C. (HEXT450) | | |

Certain physical properties for these 13 graphites, including the specific CTE for each of them, are set forth in the following Table 12 which is otherwise self-explanatory. It can be noted that samples of the green coke, calcined coke and graphite for each of these 13 graphites were observed under an optical microscope and microphotographic recordings of these observations were taken. Even an untrained eye upon inspecting these microphotographs can discern the differences between substantially isotropic graphite with a fine-grained mosaic structure, highly anisotropic graphite with an elongated grain almost lamellar structure, and in many cases partially anisotropic graphites in between. And the extent of observed anisotropicity finds good correspondence with the CTE values measured for the respective graphites.

TABLE 12

Some Properties of WVU Graphites

| Graphite | WVU-1 | WVU-2 | WVU-3 | WVU-4 | WVU-5 |
|---|---|---|---|---|---|
| Calcined Coke | CS-23676 | CS-23902 | CS-24204 | CS-24456 | CS-24489 |
| CTE × $10^{-6}$/° C. | 4.42 | 2.89 | 5.28 | 1.59 | 0.71 |
| Resistivity μ-ohm-m | 13.16 | 10.01 | 13.16 | 9.98 | 11.85 |
| Density (g/cc) | 1.51 | 1.57 | 1.57 | 1.48 | 1.38 |

| Graphite | WVU-6 | WVU-7 | WVU-8 | WVU-9 | WVU-10 |
|---|---|---|---|---|---|
| Calcined Coke | CS-24523 | CS-24580 | CS-24656 | CS-24787 | CS-25056 |
| CTE × $10^{-6}$/° C. | 4.52 | 3.77 | 1.19 | 3.12 | 5.28 |
| Resistivity μ-ohm-m | 14.71 | 15.10 | 10.18 | 11.56 | 8.96 |
| Density (g/cc) | 1.57 | 1.50 | 1.48 | 1.59 | 1.51 |

| Graphite | WVU-11 | WVU-12 | WVU-13 |
|---|---|---|---|
| Calcined coke | CS-25115 | CS-25148 | CS-25150 |
| CTE × $10^{-6}$/° C. | 5.07 | 1.09 | 0.96 |
| Resistivity μ-ohm-m | 13.77 | 10.10 | 11.76 |
| Density (g/cc) | 1.61 | 1.47 | 1.42 |

That which is claimed is:

1. A method which comprises the steps of:

extracting a first bituminous coal in an extraction solvent to yield a first extracted fraction forming after calcination a substantially isotropic coke, said solvent having the general formula $R_n$—M(═O)(—$R^1$)—N—$R^2R^3$, where M is a carbon, sulfur, or phosphorous atom, $R^2$ and $R^3$ are each a hydrogen atom or a lower alkyl group, R and $R^1$ are each a lower alkyl group, another —N—$R^2R^3$ group or $R^1$ is another $R_n$—M(═O)(—$R^1$)—N—$R^2$— group, or together $R^1$ and $R^2$ represent the atoms necessary to close a 5-membered heterocyclic ring, and n is unity where M is phosphorous and otherwise zero;

hydrogenating a second bituminous coal which is the same or different as the first coal in a proton-donating liquid medium and extracting the hydrogenated coal in said solvent to yield a second extracted fraction, the conditions of the hydrogenation being selected so that said second fraction will yield after calcination a highly anisotropic coke;

calcining into coke each of a plurality of test samples including a first sample made substantially entirely of said first fraction, a second sample made substantially entirely of said second fraction, and at least one additional sample obtained by dissolving in said solvent amounts of both said fractions in at least one proportion and determining the respective degrees of anisotropy of all calcined samples;

determining a relationship between the proportions of said two fractions in said calcined samples and their degrees of anisotrophy and from said relationship identifying that proportion of the two fractions which after calcination would give a coke substantially having a desired degree of anisotropy ranging between the degrees of anisotrophy of said first and second calcined samples; and dissolving in the solvent amounts of the two fractions in that proportion identified to form a solution and recovering a solid extraction product which will produce after calcination a calcined coke having substantially said desired degree of anisotrophy.

2. The method of claim 1 wherein each calcined test sample is converted into a graphite sample and a coefficient of thermal expansion (CTE) value is determined therefor as a measurement of the degree of anisotrophy of the corresponding calcined sample and said relationship is determined between the proportions of said two fractions in said calcined samples and the CTE values of corresponding graphite samples.

3. A method according to claim 2 wherein said graphite samples range in CTE values from a CTE value in the axial direction of not greater than about $1\times10^{-6}$/°C. for the sample produced from the coke obtained from said second extract to a CTE value of at least about $4\times10^{-6}$/°C. for the sample produced from the coke obtained from said first extract.

4. A method according to claim 1 which further comprises the step of subjecting said solid blend to calcination to yield a coke having substantially said desired degree of anisotrophy.

5. The method of claim 1 wherein at least two additional test samples are obtained by dissolving in said solvent both said fractions in at least two different proportions.

6. A method according to claim 4 which further comprises the step of subjecting the calcined coke produced from said solid blend to graphitization to yield a graphite having substantially said desired degree of anisotrophy.

7. A method which comprises the steps of:

extracting a first bituminous coal in an extraction solvent to yield a first extracted fraction which after calcination will form a substantially isotropic coke, said solvent having the general formula $R_n$—M(═O)(—$R^1$)—N—$R^2R^3$, where M is a carbon, sulfur, or phosphorous atom, $R^2$ and $R^3$ are each a hydrogen atom or a lower alkyl group, R and $R^1$ are each a lower alkyl group, another —N—$R^2R^3$ group or $R^1$ is another $R_n$—M(═O)(—$R^1$)—N—$R^2$— group, or together $R^1$ and $R^2$ represent the atoms necessary to close a 5-membered heterocyclic ring, and n is unity where M is phosphorous and otherwise zero;

hydrogenating a second bituminous coal which is the same or different as the first coal in a proton-donating liquid medium and extracting the hydrogenated coal in said solvent to yield a second extracted fraction, the conditions of the hydrogenation being selected so that said second fraction after calcination will yield a highly anisotropic coke;

calcining each of a plurality of test samples including a first sample constituted substantially entirely of said first fraction, a second sample constituted substantially entirely of said second fraction, and at least one additional sample obtained by blending in said solvent amounts of both said fractions in at least one proportion and determining the degrees of anisotropy of all calcined samples;

calculating the percentages of said first and second extracted fractions relative to the coals from which they were extracted;

determining a relationship between the percentages of said fractions in said two coals, the proportions of said two fractions in said calcined samples and the degrees of anisotrophy thereof and from said relationship identifying that proportion in which the two coals would need to be mixed and subjected to a common extraction in said solvent to yield a solid extracted blend containing said two fractions in that proportion which when said solid blend is calcined into coke imparts to the coke substantially a desired degree of anisotropy in a range between the degrees of anisotrophy of said first and second calcined test samples; and mixing said two coals in the thus-identified proportion and subjecting the coal mixture to extraction in said solvent to dissolve fractions of the two coals in said solvent and recovering from said solvent a solid extraction product which after calcination will produce a calcined coke having substantially said desired degree of anisotrophy.

8. A method according to claim 7 which further comprises the step of subjecting said said solid extracted blend to calcination to produce coke having substantially said desired degree of anisotropy.

9. A method according to claim 8 which further comprises the step of subjecting said coke produced from said solid extracted blend to graphitization to produce graphite having substantially said desired degree of anisotrophy.

10. The method of claim 7 wherein each calcined test sample is converted into a graphite sample and a coefficient of thermal expansion (CTE) value is determined therefor as a measurement of the degree of anisotrophy of the corresponding calcined sample and said relationship is determined between said coefficient of thermal expansion values, the proportions of said two fractions in said calcined samples and said calculated percentages of said two fractions in the original coals.

11. The method of claim 7 wherein at least two additional test samples are obtained by dissolving in said solvent both said fractions in at least two different proportions.

12. A method according to claim 10 wherein said graphite samples range in CTE values from a CTE value in the axial direction of not greater than about $1\times10^{-6}$/°C. for the sample produced from the coke obtained from said second extract to a CTE value of at least about $4\times10^{-6}$/°C. for the sample produced from the coke obtained from said first extract.

13. A method according to claim 10 wherein said graphite samples range in CTE values from a CTE value in the axial direction of not greater than about $1\times10^{-6}$/°C. for the sample produced from the coke obtained from said second extract to a CTE value of at least about $4\times10^{-6}$/°C. for the sample produced from the coke obtained from said first extract.

14. A method which comprises the steps of:

subjecting a plurality of samples of a bituminous coal to hydrogenation in a proton-donating liquid medium under a series of differing hydrogenation conditions and extracting the thus-hydrogenated samples separately in an extraction solvent to recover a plurality of extracted solid fractions of said coal, said series of hydrogenation conditions ranging from a first extreme condition which yields a first solid fraction having a Mettler softening point greater than 300° C. and an absolute viscosity greater than 10,000 poises at 330° C., to a second extreme condition which yields a second solid fraction having a Mettler softening point less than 150° C. and an absolute viscosity between about 100 to about 200 poises at 160° C. and including at least one additional condition between said extreme conditions which yields a solid fraction having a Mettler softening point and absolute viscosity intermediate the stated values for said first and second solid fractions, said solvent having the general formula $R_n$—M(=O) (—$R^1$)—N—$R^2R^3$, where M is a carbon, sulfur, or phosphorous atom, $R^2$ and $R^3$ are each a hydrogen atom or a lower alkyl group, R and $R^1$ are each a lower alkyl group, another —N—$R^2R^3$ group or $R^1$ is another $R_n$—M(=O) (—$R^1$)—N—$R^2$— group, or together $R^1$ and $R^2$ represent the atoms necessary to close a 5-membered heterocyclic ring, and n is unity where M is phosphorous and otherwise zero;

separately calcining all of the solid fractions into coke test samples and determining the degrees of anisotrophy of said samples;

determining a relationship between the degrees of anisotropy of said coke samples and the differing conditions of hydrogenation and from said relationship identifying that hydrogenation condition that would need to be applied to the coal to produce after extraction of the hydrogenated coal and calcination a calcined coke having substantially a desired degree of anisotropy in a range between the degrees of anisotrophy of the calcined test samples obtained from said first and second solid fractions; and then hydrogenating a quantity of said coal under that condition, and extracting the hydrogenated coal in said solvent to produce an extraction product which after calcination gives a coke substantially having the desired degree of anisotrophy.

15. The method of claim 14 wherein each calcined test sample is converted into a graphite sample and a coefficient of thermal expansion (CTE) value is determined therefor as a measurement of the degree of anisotrophy for the corresponding calcined sample and said relationship is determined between the CTE values and the differing hydrogenation conditions for the corresponding samples.

16. The method of claim 14 wherein at least two additional test samples are obtained by hydrogenating coal samples under at least two additional conditions between said extreme conditions.

17. A method according to claim 14 which further comprises the step of calcining said extraction product into coke having substantially said desired degree of anisotrophy.

18. A method according to claim 17 which further comprises the step of subjecting the calcined coke produced from said extraction product to graphitization to yield a graphite having substantially said desired degree of anisotrophy.

* * * * *

UNITED STATES PATENT AND TRADEMARK OFFICE

CERTIFICATE OF CORRECTION

PATENT NO. : 5,955,375

DATED : September 21, 1999

INVENTOR(S) : JOHN W. ZONDLO ET AL

It is certified that error appears in the above-identified patent and that said Letters Patent is hereby corrected as shown below:

Col. 18, line 9, change "extraction product" to --extracted blend--.

Col. 19, lines 16 & 17, change "extraction product" to --extracted blend--.

Signed and Sealed this

Twenty-fifth Day of April, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. : 5,955,375
DATED : September 21, 1999
INVENTOR(S) : John W. Zondlo et al.

It is certified that error appears in the above-identified patent and that said Letters Patent is hereby corrected as shown below:

Column 19,
Line 46, change "10" to -- 15 --.
Lines 49 and 51, change "extract" (each occurrence) to -- extracted solid fraction --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*